US010306997B2

(12) United States Patent
Eizinas et al.

(10) Patent No.: US 10,306,997 B2
(45) Date of Patent: Jun. 4, 2019

(54) PRODUCT DISPLAY APPARATUS

(71) Applicant: ARRAY CANADA, INC., Toronto (CA)

(72) Inventors: Alexis Eizinas, Toronto (CA); Arthur E. Landi, Greenwich, CT (US)

(73) Assignee: ARRAY CANADA, INC., Toronto, ON (CA)

( * ) Notice: Subject to any disclaimer, the term of this patent is extended or adjusted under 35 U.S.C. 154(b) by 0 days.

(21) Appl. No.: 16/164,383

(22) Filed: Oct. 18, 2018

(65) Prior Publication Data

US 2019/0116993 A1 Apr. 25, 2019

Related U.S. Application Data

(60) Provisional application No. 62/574,733, filed on Oct. 19, 2017.

(51) Int. Cl.

| | |
|---|---|
| ***A47F 5/00*** | (2006.01) |
| ***A47F 7/00*** | (2006.01) |
| ***A47F 5/16*** | (2006.01) |
| *A47B 47/00* | (2006.01) |
| *A47B 96/02* | (2006.01) |

(52) U.S. Cl.

CPC ..... *A47F 5/0062* (2013.01); *A47F 5/16* (2013.01); *A47F 7/0042* (2013.01); *A47B 47/00* (2013.01); *A47B 96/027* (2013.01); *A47F 5/005* (2013.01); *A47F 2005/165* (2013.01)

(58) Field of Classification Search

CPC ..... A47F 5/0062; A47F 7/0042; A47F 5/16; A47F 2005/165; A47F 5/005; A47B 47/00; A47B 96/027

USPC ..... 211/90.01, 90.02, 88.01, 184, 119.003, 211/134; 248/235, 240.2, 241, 250, 248/441.1, 520; 108/108, 147.11, 147.17

See application file for complete search history.

(56) References Cited

U.S. PATENT DOCUMENTS

| | | | | |
|---|---|---|---|---|
| 704,957 A * | 7/1902 | Croom | ..... | A47B 96/061 248/214 |
| 945,280 A * | 1/1910 | Lindberg | ..... | A47B 57/045 108/10 |
| 1,276,781 A * | 8/1918 | Lynds | ..... | A47B 87/02 211/184 |

(Continued)

OTHER PUBLICATIONS

An International Search Report and the Written Opinion issued by the International Searching Authority dated Mar. 14, 2019 in connection with PCT/IB2018/001301.

*Primary Examiner* — Jonathan Liu
*Assistant Examiner* — Devin K Barnett
(74) *Attorney, Agent, or Firm* — Baker & McKenzie LLP

(57) ABSTRACT

The present disclosure generally relates to a display apparatus for displaying product. The display apparatus includes a base tray having a plurality of ribs coupled to the base tray. The plurality of ribs are angled upward from a rear of the base tray towards a front of the base tray. Each rib includes a slot defined therein and a front angled portion. The display apparatus further includes a merchandiser tray carrier coupled to the base tray via the ribs. A merchandiser tray is disposed over the merchandiser tray carrier. A rail is coupled to the ribs such that it is flush with the front angled portions of the ribs, thereby defining an angle of display of product. Related methods of use of the display chassis are also described.

19 Claims, 8 Drawing Sheets

(56) References Cited

U.S. PATENT DOCUMENTS 1,609,945 A * 12/1926 Hermani ..... A47F 3/14 211/135
1,704,365 A * 3/1929 McCauley ..... A47F 5/0062 211/128.1
1,772,619 A * 8/1930 Warren ..... A47B 67/02 211/90.01
2,049,594 A * 8/1936 Stultz ..... A47F 3/06 211/87.01
2,143,396 A * 1/1939 West ..... A47F 5/0062 211/128.1
2,310,326 A * 2/1943 Swartwout ..... A47F 5/01 108/108
2,444,584 A * 7/1948 Touchett ..... B44D 3/126 15/257.06
2,801,753 A * 8/1957 Shaw ..... H05K 13/0053 211/126.2
3,097,746 A * 7/1963 Handler ..... A47B 57/425 108/108
4,403,700 A * 9/1983 Manlove ..... B43M 99/008 211/88.01
4,509,648 A * 4/1985 Govang ..... A47F 5/0846 211/59.1
4,775,058 A 10/1988 Yatsko
4,850,285 A * 7/1989 Suttles ..... A47F 5/103 108/108
4,854,535 A * 8/1989 Winter ..... A47B 57/42 248/220.22
5,255,802 A * 10/1993 Krinke ..... A47F 5/005 211/184
5,314,081 A * 5/1994 Carroll ..... A47B 87/005 211/11
5,626,246 A * 5/1997 Roddy ..... A47F 5/0062 108/64
5,673,801 A * 10/1997 Markson ..... A47F 1/126 211/184
6,230,907 B1 * 5/2001 Stuart ..... A47B 55/02 108/108
6,345,579 B1 * 2/2002 Zaturensky ..... A47B 96/028 108/108
6,588,863 B1 * 7/2003 Yatchak ..... A47B 3/0803 108/147.11
6,845,871 B1 * 1/2005 Culp ..... A47B 47/042 211/184
6,883,671 B2 * 4/2005 Rushing ..... A47F 5/0018 206/736
6,929,131 B1 * 8/2005 Landi ..... A47F 5/0846 211/87.01
7,114,300 B1 * 10/2006 Culp ..... A47B 47/042 52/211
7,270,385 B2 * 9/2007 Mathur ..... A47B 96/025 108/108
8,087,522 B2 * 1/2012 Stafford ..... A47F 5/0025 108/108
8,231,017 B2 * 7/2012 Clontz ..... A47F 5/0043 211/134
8,607,970 B2 * 12/2013 De Lecce ..... A47F 7/024 206/566
8,899,162 B2 * 12/2014 Chikkakalbalu ..... A47B 96/027 108/108
8,960,827 B2 * 2/2015 McMillin ..... A47B 96/027 108/108
9,422,960 B2 * 8/2016 Lortie ..... F16B 12/12
9,615,640 B2 * 4/2017 Westphal ..... A45C 11/16
9,615,677 B2 * 4/2017 Trinh ..... A47F 5/0087
10,130,196 B2 * 11/2018 Burns ..... F21V 23/06
10,172,454 B2 * 1/2019 Moon ..... A47B 57/265
2002/0027115 A1 * 3/2002 Gay ..... A47B 57/045 211/187
2003/0173876 A1 * 9/2003 Fujii ..... A47F 5/0093 312/116
2003/0233965 A1 * 12/2003 Brazier ..... A47B 96/028 108/108
2004/0238708 A1 * 12/2004 Berry ..... A45C 11/26 248/314
2005/0133474 A1 * 6/2005 Nomoto ..... A47F 5/0062 211/128.1
2005/0145147 A1 * 7/2005 Costa ..... A47B 47/022 108/108
2005/0247649 A1 * 11/2005 Scholen ..... A47F 5/0846 211/26
2005/0263465 A1 * 12/2005 Chung ..... A47B 96/021 211/90.02
2007/0046160 A1 * 3/2007 Egan ..... A47B 96/02 312/408
2007/0131632 A1 * 6/2007 Brown ..... A47B 87/0261 211/126.13
2007/0205167 A1 * 9/2007 Belokin ..... A47F 5/0018 211/75
2010/0163501 A1 * 7/2010 Berry ..... A47F 5/0087 211/55
2010/0258513 A1 * 10/2010 Meyer ..... A47F 1/126 211/59.3
2011/0062294 A1 * 3/2011 Johnson ..... A47F 7/024 248/161
2011/0100942 A1 * 5/2011 Spizman ..... A47B 57/045 211/150
2013/0213911 A1 * 8/2013 Theisen ..... A47F 5/0025 211/59.4
2013/0248475 A1 * 9/2013 Erickson ..... A47F 5/005 211/119.003
2013/0343014 A1 * 12/2013 Browning ..... A47F 3/001 361/752
2014/0250749 A1 * 9/2014 Theisen ..... F21V 33/00 40/649
2015/0020361 A1 * 1/2015 Van Buskirk ..... A47F 5/12 29/428
2015/0070928 A1 * 3/2015 Rau ..... G09F 13/18 362/604
2015/0173529 A1 * 6/2015 Hester-Redmond ..... A47F 5/08 211/59.3
2015/0230630 A1 8/2015 Taylor
2017/0076343 A1 * 3/2017 Bernstein ..... G06Q 30/0601
2018/0184816 A1 * 7/2018 Bellar ..... A47F 5/0031
2018/0360236 A1 * 12/2018 Kim ..... A47F 1/12

* cited by examiner

PRODUCT DISPLAY APPARATUS

CROSS-REFERENCE TO RELATED APPLICATIONS

This application claims priority to U.S. Provisional App. Ser. No. 62/574,733 filed on Oct. 19, 2017, which is hereby incorporated by reference in its entirety.

BACKGROUND

Retailers typically use on-shelf displays to present their products. As the retail landscape changes and business strategies evolve, an "open-sell" approach for creating a more accessible shopping environment has become increasingly desirable. On-shelf displays that can best fulfill the specific needs of the open-sell environment are important to such retailers.

The traditional custom build and manufacturing methods used for open-sell retailers are expensive and not sustainable. For example, metal husks that traditionally house open-sell systems are highly customized—requiring complex, expensive detailing, are heavy, difficult to install and sit in landfills at their end-of-life. The typical processes of gluing and taping unlike materials together as part of the test/merchandising systems mean that updates cannot be disassembled for recycling.

BRIEF SUMMARY

The present disclosure generally relates to a product display chassis (apparatus) that allows open-sell shelves to be more sustainable, easier to update, yet flexible—requiring little customization to create the unique brand expression that is needed on-shelf. The display apparatus includes a base tray having a plurality of ribs coupled to the base tray. The plurality of ribs are usually angled upward from a rear of the base tray towards the front of the base tray. Each rib includes a slot defined therein and a front angled portion. The display apparatus further includes a merchandiser tray carrier coupled to the base tray via the ribs. A merchandiser tray is disposed over the merchandiser tray carrier. A rail is coupled to the ribs such that it is flush with the front angled portions of the ribs, thereby creating the top support for a tester tile system and defining an angle of display of product. A second rail with an angle defined and related to the rib's front angled portion is coupled to the front of the base tray, creating the bottom support for the tester tile system.

In another embodiment, a display apparatus is described as including a base tray having a plurality of ribs coupled to the base tray. The plurality of ribs are angled upward from a rear of the base tray towards a front of the base tray. Each of the plurality of ribs has a slot defined therein and a front angled portion. A merchandiser tray carrier is coupled to the base tray via the plurality of ribs. A merchandiser tray is disposed over the merchandiser tray carrier. A tester tile carrier is disposed over the base tray and adjacent to the merchandiser tray. The tester tile carrier has a tester tile coupled thereto. An angle measured from the a surface of the merchandiser tray and a surface of the tester tile is greater than 90 degrees.

Related methods of use of the display chassis are also described. The display chassis system may be completely hidden by custom brand decoration and acts as a feature-filled base structure that replaces hyper customized systems and heavy, complex metal husks.

BRIEF DESCRIPTION OF THE DRAWINGS

Reference is now made to the following descriptions taken in conjunction with the accompanying drawings.

DETAILED DESCRIPTION

Various embodiments of a product display chassis, system and methods of using such a display chassis according to the present disclosure are described. It is to be understood, however, that the following explanation is merely exemplary in describing the devices and methods of the present disclosure. Accordingly, several modifications, changes and substitutions are contemplated.

Figure 1:
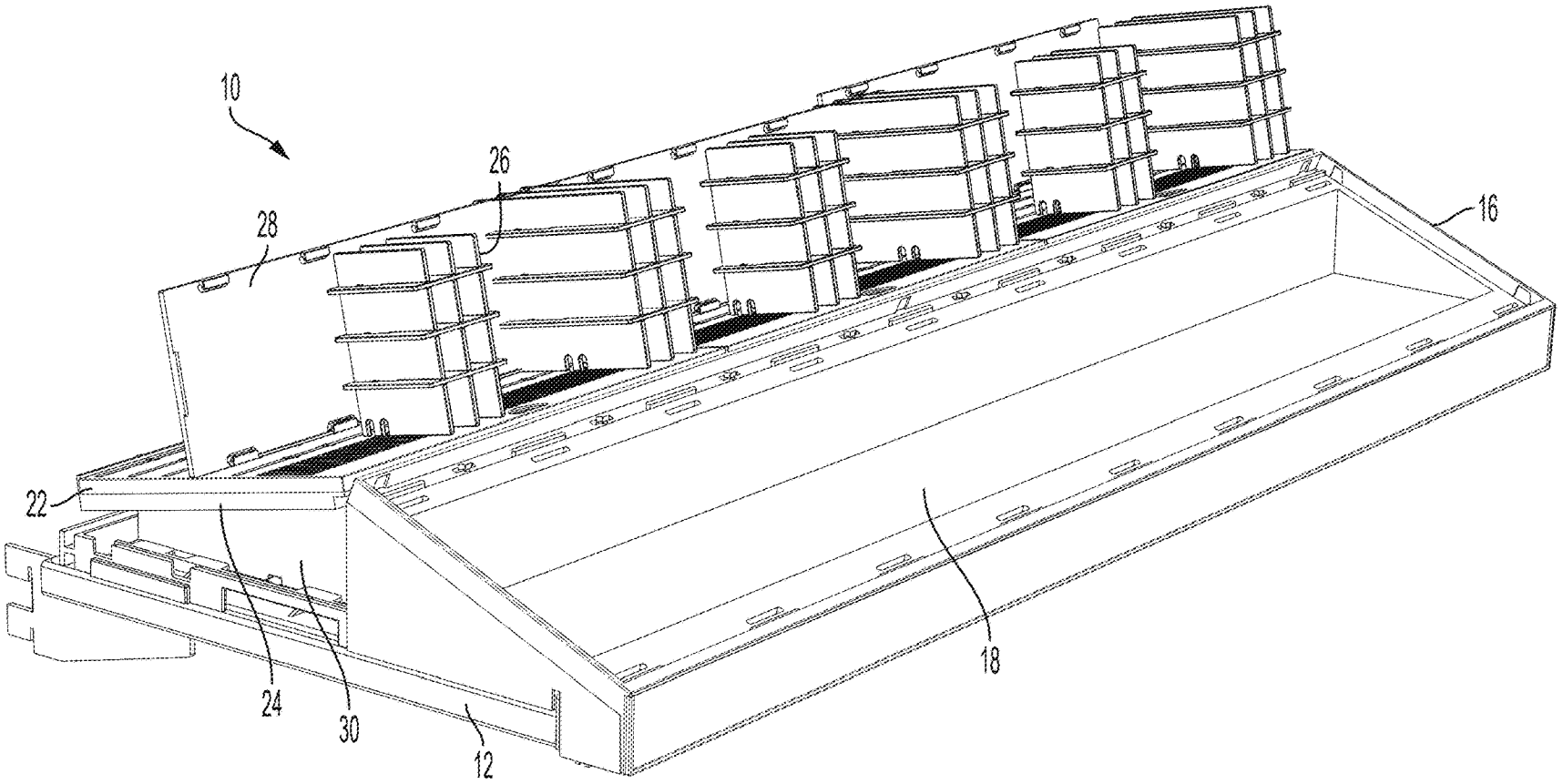
FIG. 1 illustrates a perspective view of a product display chassis according to one embodiment of the present disclosure.

A display chassis according to one embodiment of the present disclosure is denoted with reference numeral 10 in FIG. 1. The display chassis 10 includes a base tray 12 disposed at a lower portion of the product display chassis. The base tray 12 may be placed over a retailer's shelf (not shown) at a desired location within the store. An integrated locking mechanism may be used to align and couple the base tray with an adjacent base tray.

A decorative frame 16 may be disposed into a pair of rails (upper and lower rails 50, 60 shown in FIG. 2) of the display chassis 10. The upper and lower rails 50, 60 accept and locate a vac-form undercarriage insert 16 to support tested product or graphics. The display chassis 10 may include a moveable merchandiser tray 22 disposed on top of a merchandiser tray carrier 24. The merchandiser tray 22 may be sectional, and each section of the merchandiser tray may include one or more sets of inserted dividers 26 for merchandising product. Various configurations of dividers 26 are contemplated such as the triple-stack embodiment shown in FIG. 1. Other configurations of dividers 26 may include double-stack or single-stack, singular, long or short. The dividers 26 may be used to organize, store and display product. In some embodiments, the dividers 26 inserted in the moveable merchandiser tray 22 can be pulled out from the merchandiser tray carrier 24 by retail store staff (as illustrated in FIG. 3). In this way, the display chassis system 10 allows the staff to reorganize the dividers 26, restock merchandise that has been placed into each section of the merchandiser tray 22, or otherwise customize the merchandiser tray easily away from the confines of the shelf and then replace it. The merchandiser tray 22 further includes a back wall 28 that may be used for merchandised product but also to display product specific graphics.

Figure 2:
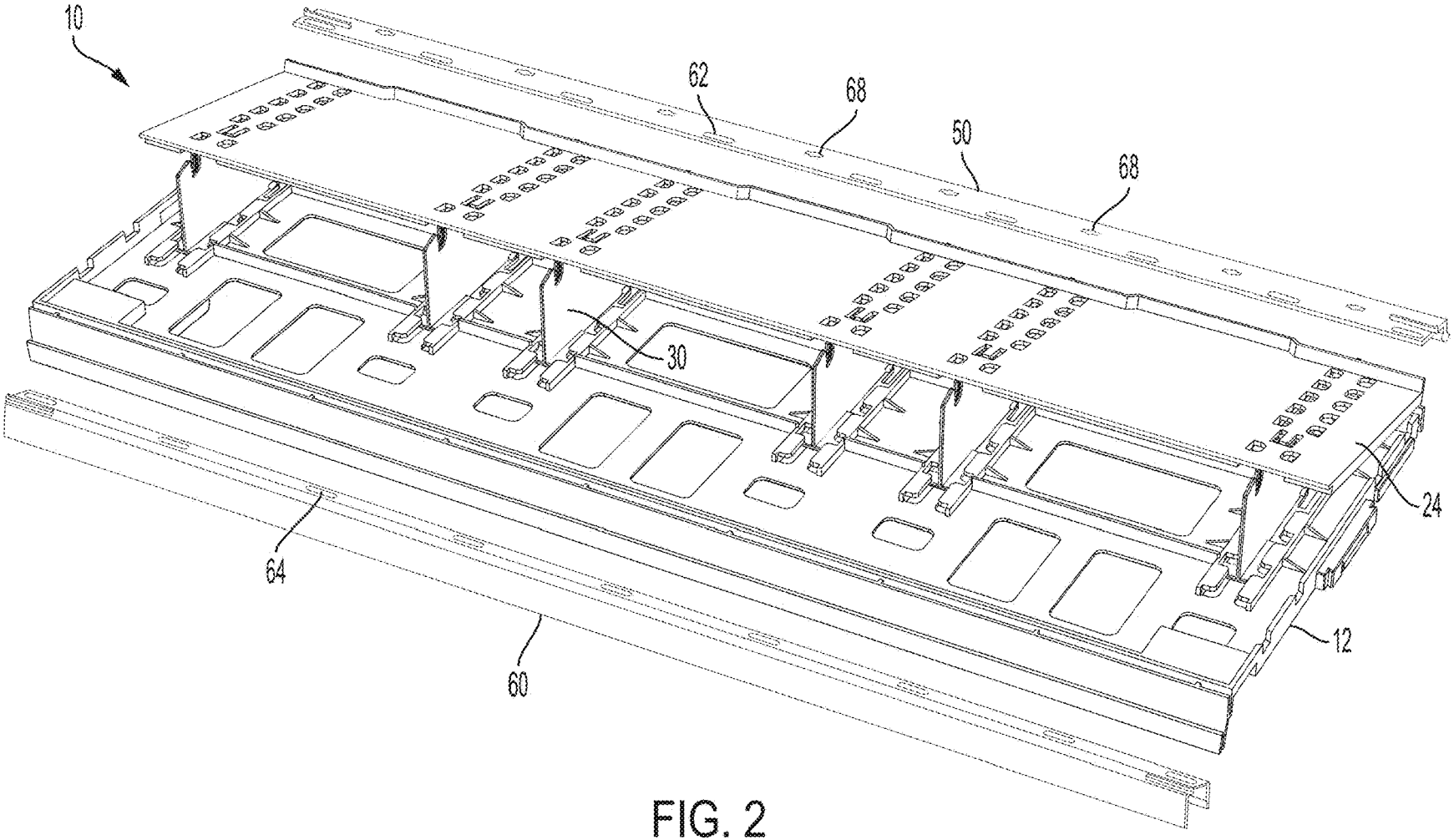
FIG. 2 illustrates a perspective view of the product display chassis of FIG. 1 with components removed and upper and lower rails detached.
Figure 3:
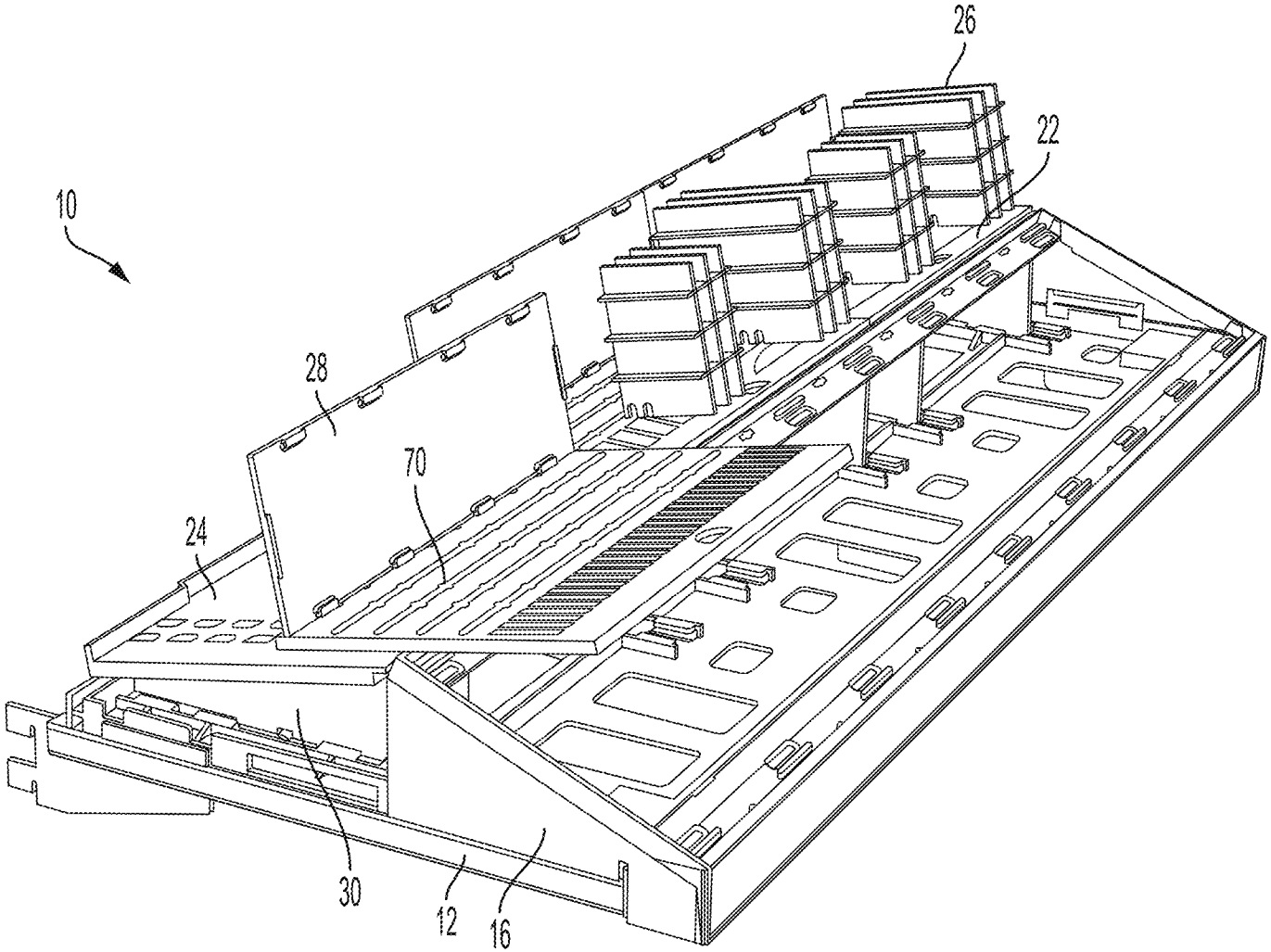
FIG. 3 illustrates a perspective view of the product display chassis of FIG. 1 having a moveable tray.
Figure 7:
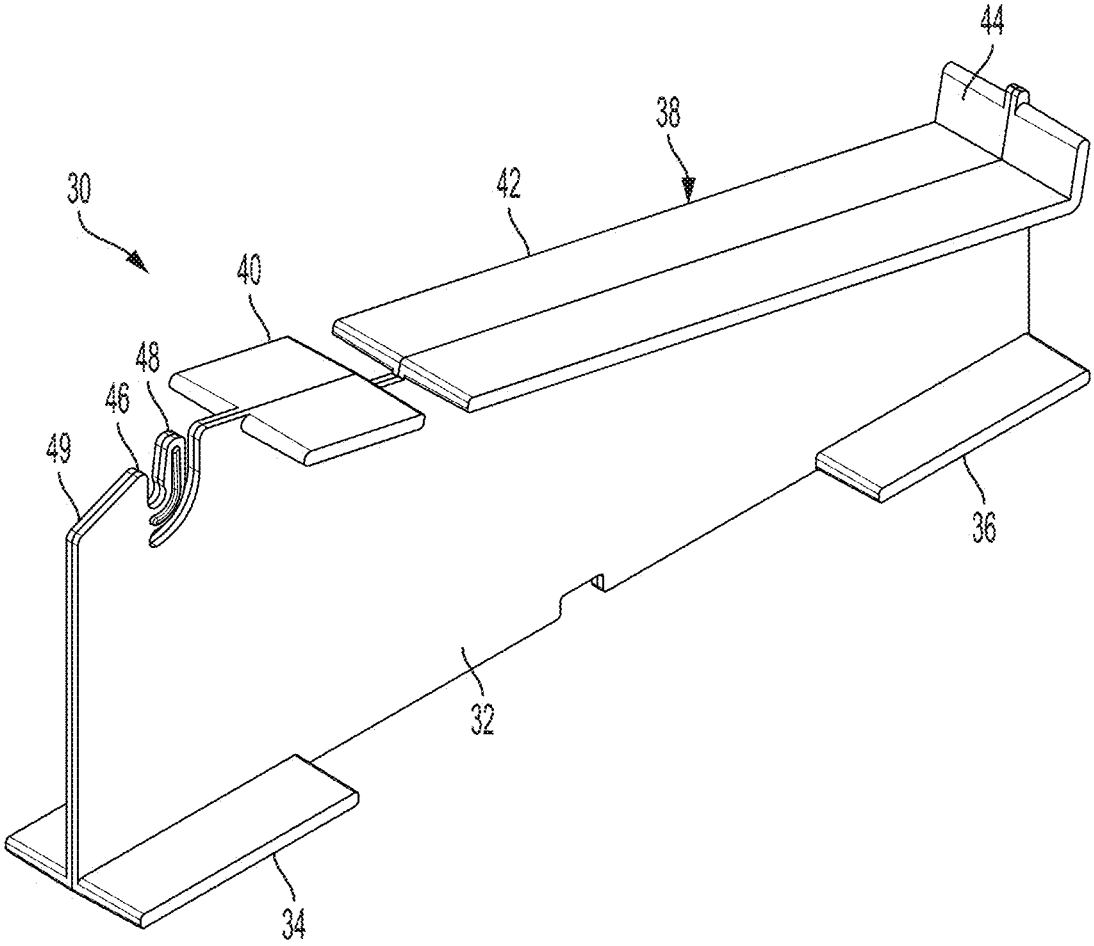
FIG. 7 illustrates a support rib configuration for a product display chassis according to the present disclosure.

As best shown in FIGS. 2 and 3, a plurality of ribs 30 may be used to support the merchandise tray carrier 24 within the display chassis 10. The ribs 30 may be angled from rear to front to provide the desired angle for the merchandiser tray 22 within the display chassis 10. The ribs 30 may be modified in height, angle and depth to allow for different configurations for the product display chassis 10 as will be further described. FIG. 7 illustrates an exemplary rib 30 according to the present disclosure. The rib 30 includes a vertically extending frame portion 32 with a horizontally extending front base portion 34 and horizontally extending rear base portion 36 for supporting the rib within the display chassis 10. The rib 30 further includes a support pad 38 which may include a partitioned front support pad portion 40, a rear support pad portion 42 and a back wall 44. The front of the frame portion 32 includes a slot 46 defined therein to accommodate a rail that may be snapped into the ribs 30 as will be described. A catch 48 is disposed adjacent to the slot 46 to thereby bias against the rail when it is snapped therein, to thereby retain the rail in position. The rib 30 further includes an angled front portion 49 adjacent to the slot 46. The ribs 30 may slide into notches formed in the base tray 12 to thereby lock the ribs into place.

Figure 8:
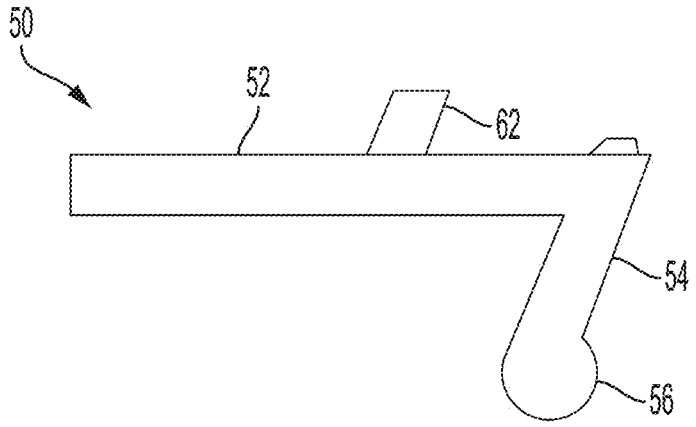
FIG. 8 illustrates an exemplary profile view of the upper rail shown in FIG. 2.
Figure 9:
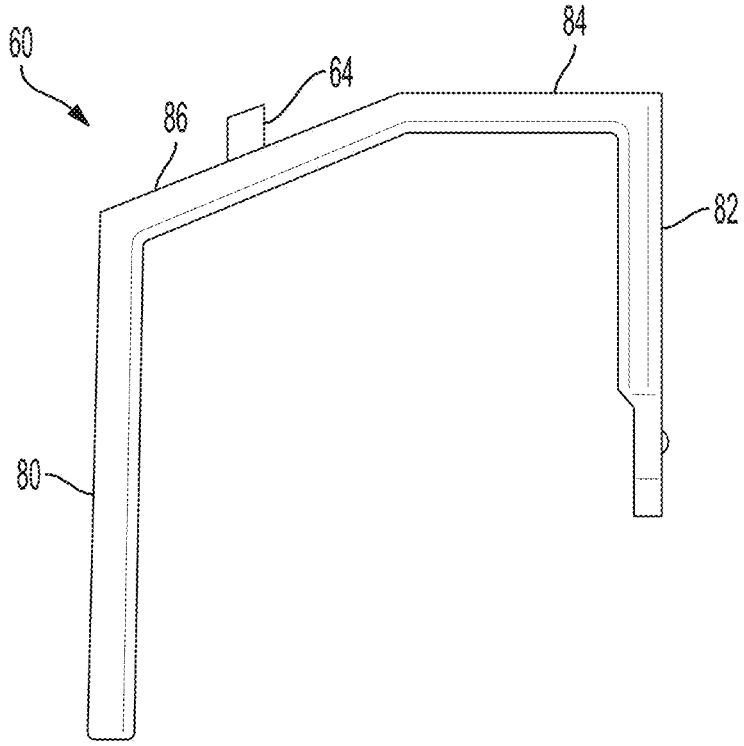
FIG. 9 illustrates an exemplary profile view of the lower rail shown in FIG. 2.

Referring again to FIGS. 2 and 3, the merchandiser tray carrier 24 may be slid onto the ribs 30 and locked into place. Once the merchandiser tray carrier 24 is in place, the upper rail 50 may be inserted into the slots 46 defined in the ribs 30. FIG. 8 illustrates an exemplary profile of the upper rail 50. The upper rail 50 includes a support portion 52 and a locking portion 54 depending downwardly from the support portion. A knob 56 is disposed at a distal end of the locking portion 54 for coupling to the slot 46 of the rib 30 described above with respect to FIG. 7. Similarly, referring to FIGS. 3 and 9, the lower rail 60 may be coupled to the base tray 12 via a slot for accommodating the lower rail. The lower rail 60 includes a pair of vertically extending legs 80, 82, a horizontally extending portion 84 and an angled portion 86. The angled portion 86 may have the same angle (e.g., relative to a horizontal axis) as the angled front portion of the rib 30.

Figure 4:
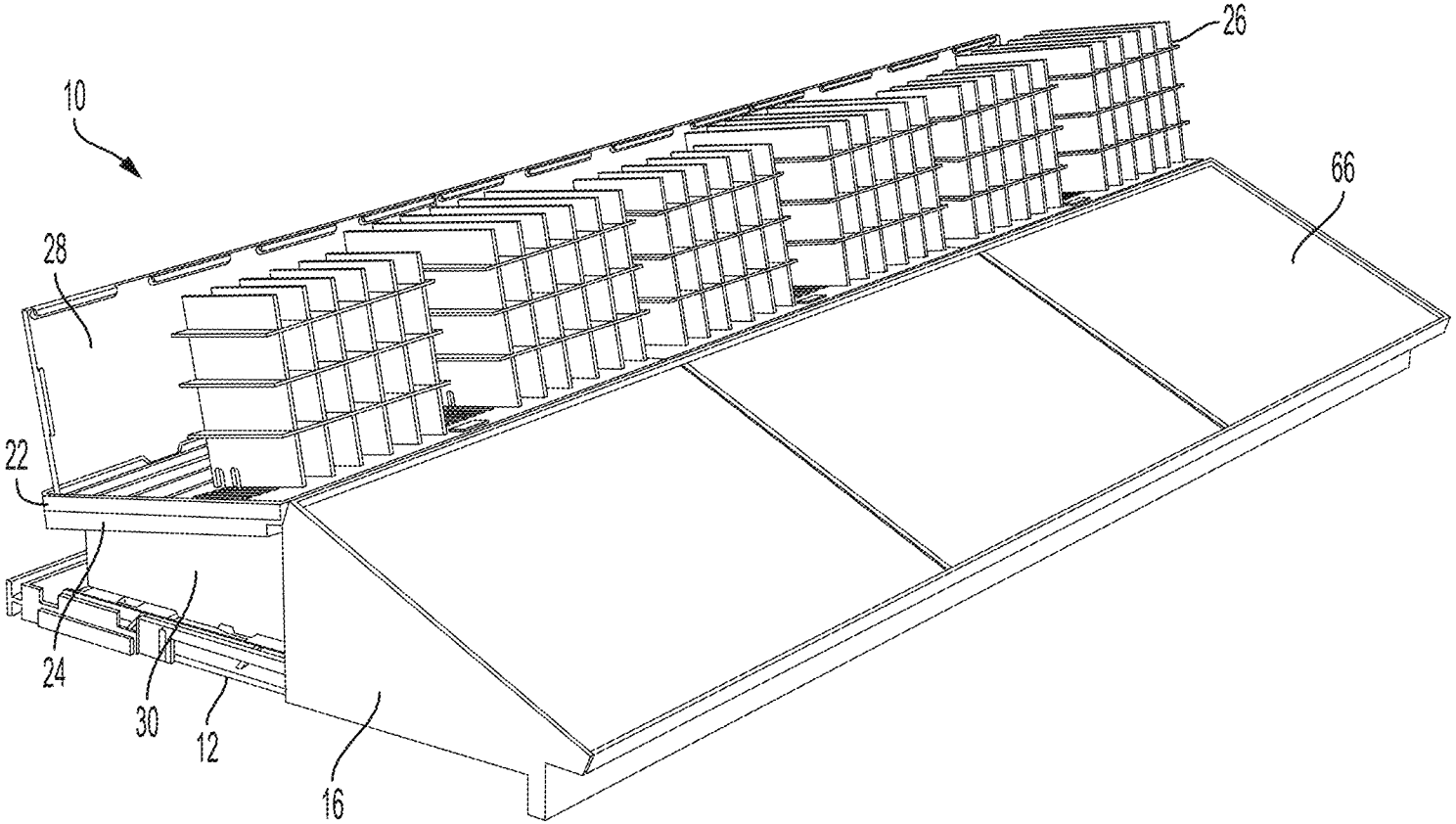
FIG. 4 illustrates a product display chassis according to the present disclosure having tester tiles.

Referring again to FIGS. 2, 8 and 9, the upper and lower rails 50, 60 may have elongated bump-outs 62, 64, respectively, for accommodating an undercarriage, such as a vac-form undercarriage that supports tester tiles 66 shown in FIG. 4. The upper rail 50 may further include a slotted cavity 68 to provide an alternative retention mechanism for decorative frames to be placed over the rails. The display chassis 10 is thus height and angle-adjusted using the ribs 30 described herein. That is, the ribs 30 may be adjusted in height, angle or depth to alter configurations for the display chassis 10. When the upper rail 50 is coupled to the rib 30, the support portion 52 is flush with the front angled portion 49 of the rib, thus defining an angle for tester tiles, product display and the like. The upper rail 50 cooperates with the lower rail 60 to define the angle for the product display. By modifying the height, angle of the angled front portion 49 or the depth of the rib, alternative display angles may be provided for the display chassis 10.

As shown in FIG. 3, a section of the merchandiser tray 22 is pulled partially out of the merchandiser tray carrier 24. Such an arrangement allows for retailer staff to reorganize dividers 26 and merchandise being held within. A staff member may place custom graphics on the back wall 28 of the merchandiser tray 22 to influence the display's color and enhance customer notice of the brand associated with the displayed product. The back wall 28 can be repositioned forward and back by retail staff to accommodate product depth using slots 70. In an embodiment, each section of the merchandiser tray 22 is approximately 12 inches in width. Of course, other dimensions are contemplated. In an embodiment, each section of the merchandiser tray 22 may be tilted about an edge of the merchandiser tray carrier 24. In an embodiment, the merchandiser tray 22 may be molded in custom colors as desired by the retailer.

Figure 5:
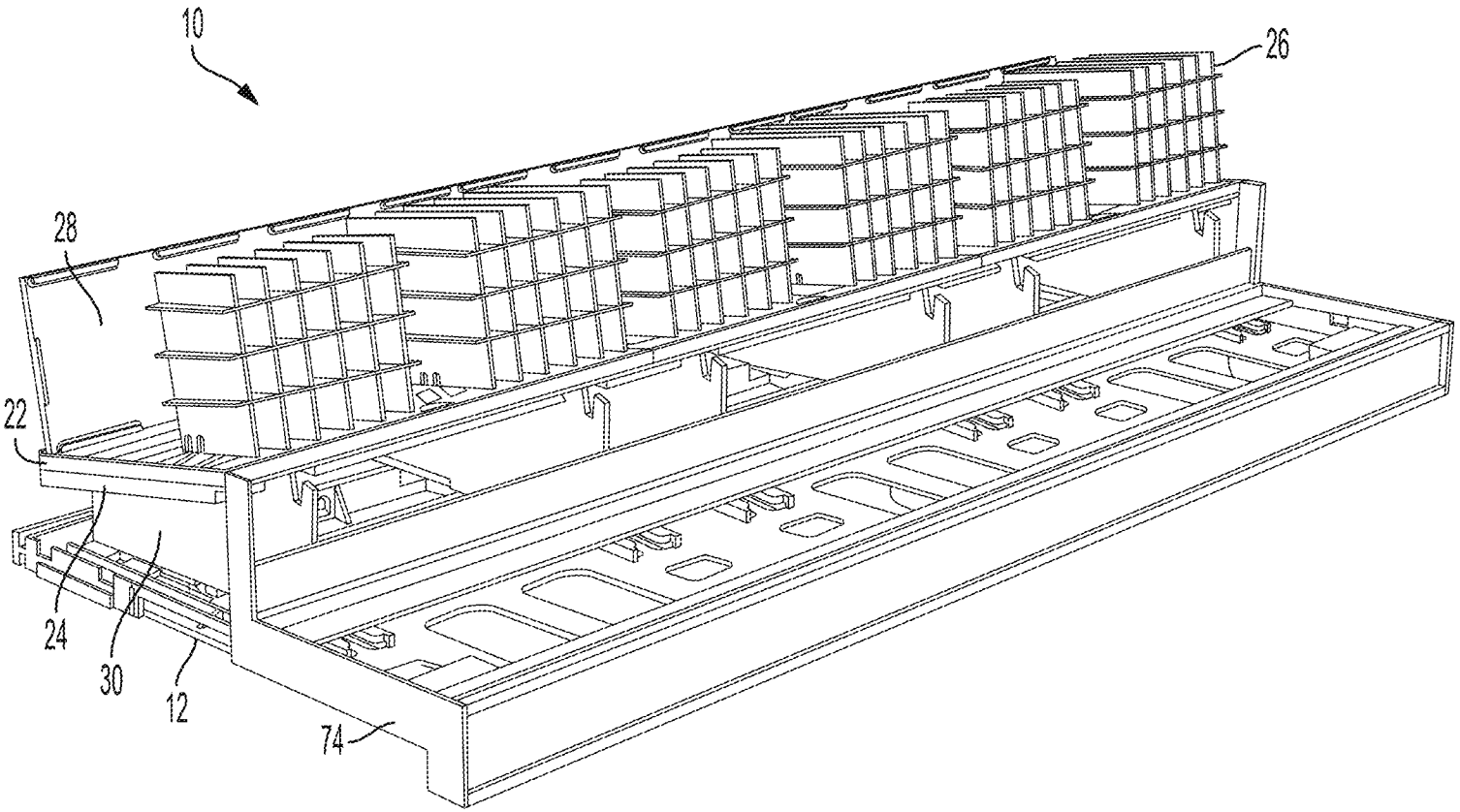
FIG. 5 illustrates a perspective view of a product display chassis having a possible configuration according to the present disclosure.
Figure 6:
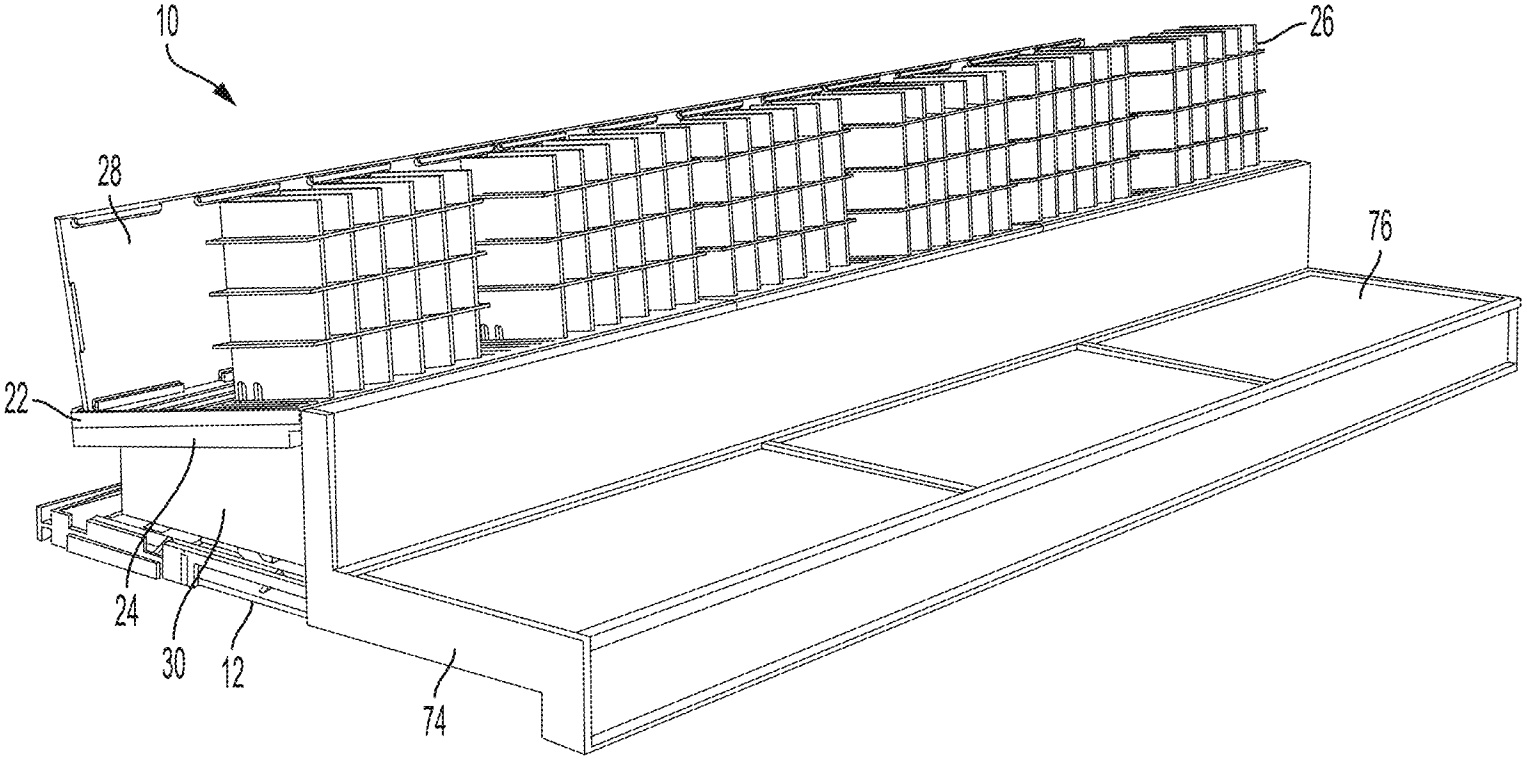
FIG. 6 illustrates a perspective view of the product display chassis of FIG. 6 having tester tiles and graphic inserts.

Referring to FIGS. 5 and 6, the display chassis 10 has been modified to have an alternative configuration. The display chassis 10 of this embodiment has a base frame 74. Rather than presenting product (such as tester tiles 76) at a downward angle to a customer, the base frame 74 accommodates the tester tiles 76 in a substantially horizontal orientation.

In an embodiment, the display chassis 10 described herein may be lightweight and minimalist, and produced from an injection mold process. The display chassis 10 may also be made from recycled and recyclable material to reduce shipping cost and environmental footprint. Further, the display chassis 10 is flexible. That is, the angle and location of the merchandiser tray 22 can change, and in relation, the angle and depth of the tester tile system can change. This allows for custom looks for brands without the bespoke customization of a singular display. The display chassis 10 can be decorated once in place via built-in features in the rails 50 and 60 and base tray 12. For example, custom frames and slide-on information/brand tickets may be applied. When the display chassis 10 is in use on display on a shelf, the display chassis 10 may be completely hidden by the brand skin or custom brand decoration of the user.

It is to be appreciated that the display chassis 10 includes various alternative configurations. In some configurations, the angle between the surface of the merchandiser tray 24 and the surface of the frame or tester tile is greater than 90 degrees. In some configurations, the angle between the surface of the merchandiser tray 24 and the surface of the frame or tester tile is greater than 180 degrees.

While various implementations in accordance with the disclosed principles have been described above, it should be understood that they have been presented by way of example only, and are not limiting. Thus, the breadth and scope of the implementations should not be limited by any of the above-described exemplary implementations, but should be defined only in accordance with the claims and their equivalents issuing from this disclosure. Furthermore, the above advantages and features are provided in described implementations, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the implementations set out in any claims that may issue from this disclosure. Specifically and by way of example, although the headings refer to a "Background," the discussion therein is not to be construed as an admission that technology is prior art to any implementations in this disclosure. Neither is the "Summary" to be considered as a characterization of the implementations set forth in issued claims. Furthermore, any reference in this disclosure to "implementation" in the singular should not be used to argue that there is only a single point of novelty in this disclosure. Multiple implementations may be set forth according to the limitations of the multiple claims issuing from this disclosure, and such claims accordingly define the implementations, and their equivalents, that are protected thereby. In all instances, the scope of such claims shall be considered on their own merits in light of this disclosure, but should not be constrained by the headings herein.

Lastly, although similar reference numbers may be used to refer to similar elements for convenience, it can be appreciated that each of the various example implementations may be considered distinct variations.

What is claimed is:

1. A display apparatus, comprising:

a base tray having a front, a rear, and a pair of opposing sides;

a plurality of ribs coupled to the base tray, wherein the plurality of ribs each define a vertically extending panel shaped frame portion having a bottom surface and an upper surface, wherein each upper surface is inclined upward from the rear of the base tray towards the front of the base tray, wherein each of the ribs are spaced apart from each other and a void is formed between each adjacent pair of ribs from said plurality of ribs;

a generally planar merchandise tray carrier coupled to the base tray via the plurality of ribs, wherein the merchandise tray carrier is mounted on top of the upper surfaces of each of the ribs;

a generally planar merchandiser tray placed on top of the merchandise tray carrier; wherein the merchandiser tray is slidable with respect to the merchandise tray carrier; wherein the merchandiser tray is inclined upwardly from the rear of the base tray towards the front of the base tray;

wherein at least one divider is mounted on top of the merchandiser tray; wherein each divider comprises:

a plurality of vertical members and a plurality of horizontal members, the vertical members and the horizontal members form a plurality rows and a plurality of columns each having a plurality of rectangular compartments for storing products therein.

2. The display apparatus of claim 1, further comprising a rail, wherein the rail comprises a support portion and a locking portion.

3. The display apparatus of claim 1, wherein the rail comprises a knob.

4. The display apparatus of claim 3, wherein the plurality of ribs each include a slot and a catch mechanism disposed adjacent to the slot.

5. The display apparatus of claim 1, wherein the at least one divider comprises a plurality of dividers.

6. The display apparatus of claim 5, wherein each divider has two rows or three rows.

7. The display apparatus of claim 1, wherein the merchandiser tray comprises a plurality of sections.

8. The display apparatus of claim 7, wherein each section of the merchandiser tray is slidable relative to the merchandise tray carrier.

9. The display apparatus of claim 1, further comprising a tester tile disposed forward of the merchandiser tray.

10. The display apparatus of claim 9, wherein the tester tile has a first surface, the merchandiser tray has a second surface, and an angle measured from the first surface to the second surface is greater than 90 degrees.

11. The display apparatus of claim 1, wherein the tester tile has a first surface, the merchandiser tray has a second surface, and an angle measured from the first surface to the second surface is greater than 180 degrees.

12. The display apparatus of claim 1, further comprising a second rail, the second rail having an angled portion.

13. A display apparatus for storing products, comprising:

a base tray having a front, a rear, and a pair of opposing sides;

a plurality of vertically extending ribs coupled to the base tray, wherein the plurality of ribs each have a bottom surface and an upper surface, wherein each upper surface is inclined upward from the rear of the base tray towards the front of the base tray; a merchandise tray carrier coupled to the base tray via the plurality of ribs, wherein the merchandise tray carrier is mounted on top of the upper surfaces of each of the ribs;

a merchandiser tray placed on top of the merchandise tray carrier, wherein the merchandiser tray is slidable with respect to the merchandise tray carrier; wherein the merchandiser tray is inclined upwardly from the rear of the base tray towards the front of the base tray, the merchandiser tray having a first top surface; and an undercarriage coupled to the base tray forward of the merchandiser tray, wherein the undercarriage has a front surface, a rear surface, and a plurality of sides, wherein a tester tile is coupled to and supported by the undercarriage, wherein the tester tile is inclined upwardly from the front of the base tray towards the rear of the base tray, the tester tile having a second top surface;

wherein an angle measured from the first top surface to the second top surface is greater than 180 degrees.

14. The display apparatus of claim 13, further comprising a rail.

15. The display apparatus of claim 14, further comprising a second rail.

16. The display apparatus of claim 14, wherein the rail comprises a support portion and a locking portion.

17. The display apparatus of claim 14, wherein the rail comprises a knob.

18. The display apparatus of claim 17, wherein the plurality of ribs each include a slot and a catch mechanism disposed adjacent to the slot.

19. The display apparatus of claim 13, wherein a plurality of dividers are coupled to the merchandiser tray for displaying product.

* * * * *